US009356350B2

(12) United States Patent
Chang et al.

(10) Patent No.: US 9,356,350 B2
(45) Date of Patent: May 31, 2016

(54) ANTENNA STRUCTURE AND WIRELESS COMMUNICATION DEVICE EMPLOYING SAME

(71) Applicant: CHUIN MAI COMMUNICATION SYSTEMS, INC., New Taipei (TW)

(72) Inventors: Tze-Hsuan Chang, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 43 days.

(21) Appl. No.: 14/300,560

(22) Filed: Jun. 10, 2014

(65) Prior Publication Data

US 2014/0361943 A1 Dec. 11, 2014

(30) Foreign Application Priority Data

Jun. 10, 2013 (TW) ..... 102120474 A

(51) Int. Cl.
*H01Q 13/10* (2006.01)
*H01Q 5/342* (2015.01)

(52) U.S. Cl.
CPC ..... *H01Q 5/342* (2015.01); *H01Q 13/10* (2013.01)

(58) Field of Classification Search
USPC ..... 343/767
See application file for complete search history.

(56) References Cited

U.S. PATENT DOCUMENTS

| | | | | |
|---|---|---|---|---|
| 6,246,377 | B1 * | 6/2001 | Aiello | H01Q 1/36 343/767 |
| 2005/0088354 | A1 * | 4/2005 | Chang | H01Q 1/38 343/767 |
| 2007/0182653 | A1 * | 8/2007 | Yoon | H01Q 1/38 343/767 |
| 2009/0060088 | A1 | 3/2009 | Callard et al. | |
| 2009/0073065 | A1 * | 3/2009 | Jordan | H01Q 13/106 343/767 |
| 2012/0313832 | A1 * | 12/2012 | Pazin | H01Q 13/106 343/767 |

OTHER PUBLICATIONS

A dual band feed structure for slot and notch antennas, 2009 IEEE ISAP, Proceedings.

* cited by examiner

*Primary Examiner* — Tan Ho
(74) *Attorney, Agent, or Firm* — Novak Druce Connolly Bove + Quigg LLP

(57) ABSTRACT

An antenna structure includes a dielectric substrate, a slot antenna, and a feeding strip. The dielectric substrate has a first surface and a second surface opposite to the first surface. The slot antenna includes a ground plane positioned on the first surface of the dielectric substrate, and a slot defined in the ground plane where the conductive material is missing. The slot opens at an edge of the ground plane. The feeding strip is positioned on the second surface of the dielectric substrate and extends across the slot, the feeding strip resonates with the slot antenna.

18 Claims, 11 Drawing Sheets

ANTENNA STRUCTURE AND WIRELESS COMMUNICATION DEVICE EMPLOYING SAME

FIELD

The subject matter herein generally relates to antenna structure, and particularly to a broadband antenna structure and a wireless communication device employing the broadband antenna structure.

BACKGROUND

With improvements in the integration of wireless communication systems, broadband antennas have become increasingly important. For a wireless communication device to utilize various frequency bandwidths, antennas having wider bandwidths have become a significant technology.

BRIEF DESCRIPTION OF THE DRAWINGS

Implementations of the present technology will now be described, by way of example only, with reference to the attached figures.

DETAILED DESCRIPTION

Figure 1:
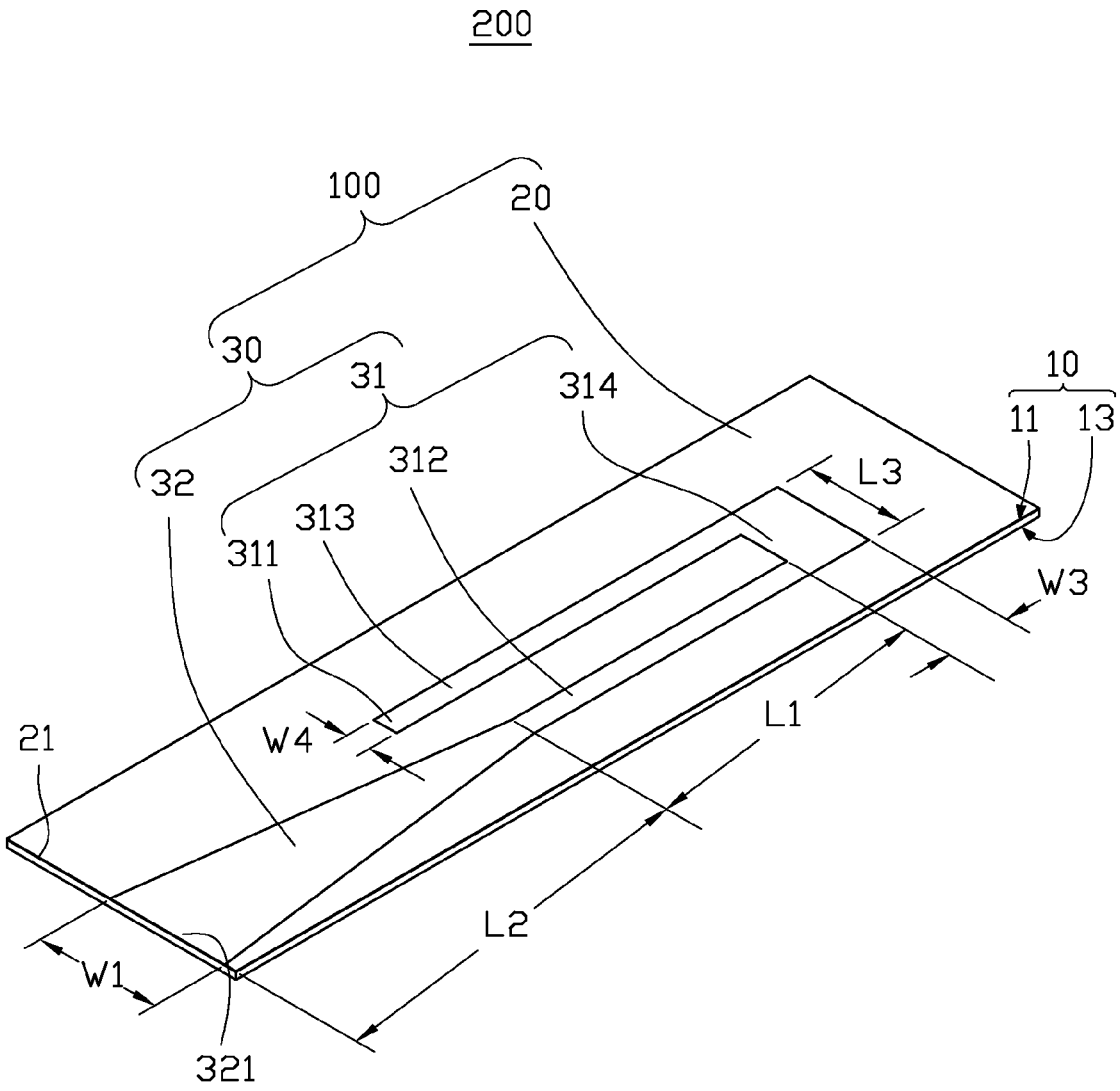
FIG. 1 is an isometric view of an embodiment of an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure that can receive/send wireless signal at a broadband frequency.

FIG. 1 illustrates an isometric view of an embodiment of an antenna structure 200. The antenna structure 200 comprises (includes, but is not limited to) a dielectric substrate 10 and a slot antenna 100. The substrate 10 has a first surface 11 and a second surface 13 opposite to the first surface. The slot antenna 100 comprises a ground plane 20 and a slot 30. The ground plane 20 is formed of a conductive material and is positioned on the first surface 11 of the dielectric substrate 10. The slot 30 is defined in the ground plane 20 where the conductive material is missing and opens through an edge 21 of the ground plane 20. The slot 30 includes a first sub-slot 31 having a closed-end 311 and a second sub-slot 32 connecting to the first sub-slot 31. The second sub-slot 32 has an open-end 321 opening through the edge 21 of the ground plane 20.

The first sub-slot 31 is substantially U-shaped, and includes a first slit 312, a second slit 313 and a connecting slit 314 connected between the first slit 312 and the second slit 313, the first slit 312 and second slit 313 are positioned on a same side of the connecting slit 314. In one embodiment, the second slit 313 and the connecting slit 314 cooperatively form a substantially straight slit. The second sub-slot 32 is connected to an end of the first slit 312 opposite to the connecting slit 314. In one embodiment, the second sub-slot 32 is substantially trapezoidal shaped.

In one embodiment, a width W1 of the open-end 321 is about 9 millimeters (mm) A length L1 of the first slit 312 is about 20.75 mm. A length L2 of the second sub-slot 32 is about 28.75 mm. A length L3 of the connecting slit 314 is about 7 mm. A width W3 of the connecting slit 314 is about 6.5 mm; and a width W4 of the second slit 313 is about 2.5 mm.

Figure 2:
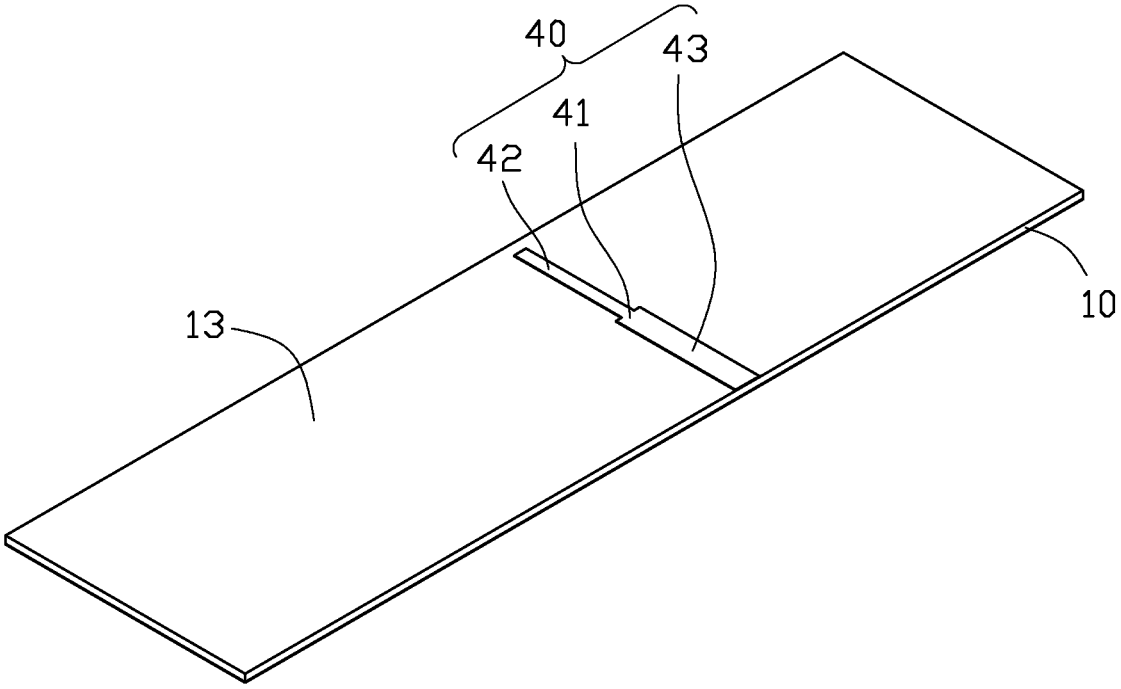
FIG. 2 is similar to FIG. 1, but showing the antenna structure in another view angle.

FIG. 2 is similar to FIG. 1, but illustrates another viewing angle. The antenna structure 200 further includes a feeding strip 40 positioned on the second surface 13 of the dielectric substrate 10. The feeding strip 40 is formed of a conductive material and resonates with the slot 30 to receive/send wireless signals. The feeding strip 40 includes a first strip 41, and a second strip 42 extending continuously from and narrower than the first strip 41.

Figure 3:
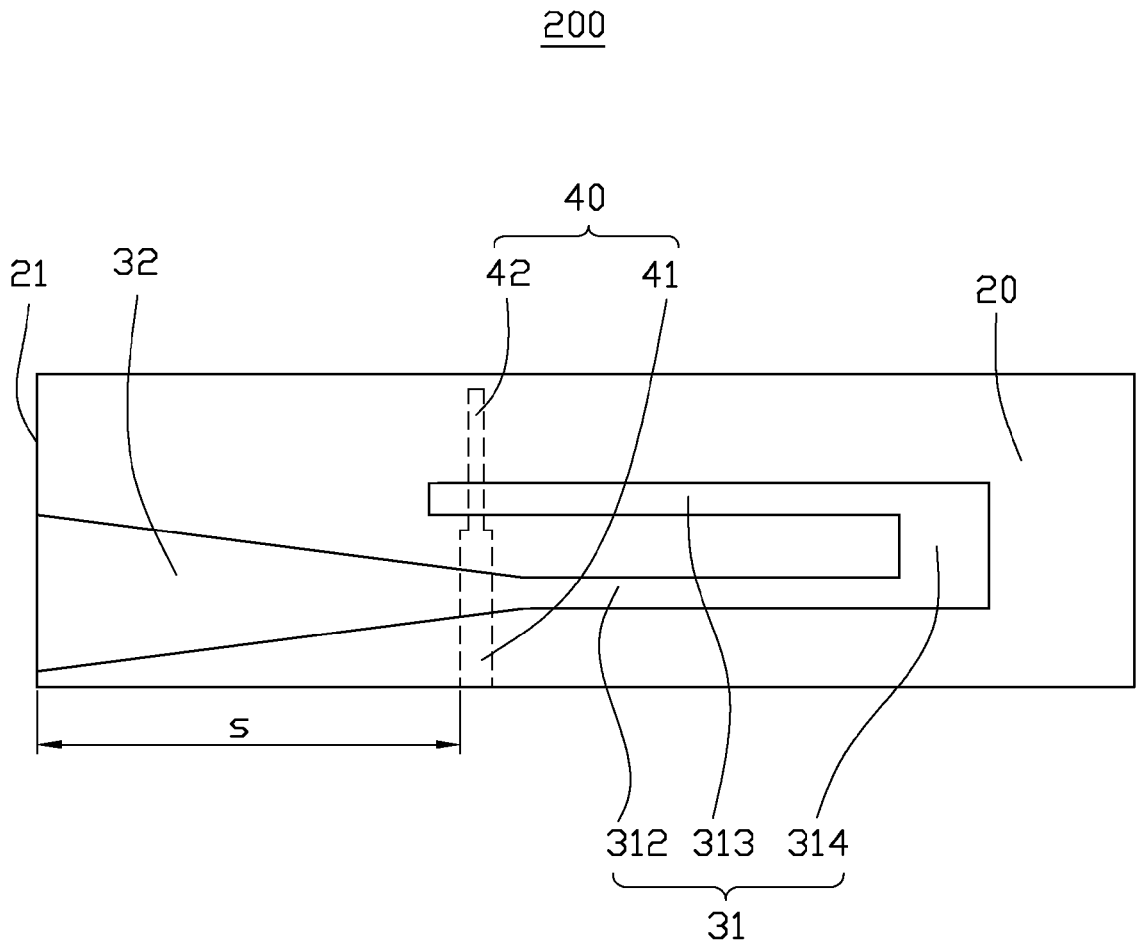
FIG. 3 is a front elevational view of the antenna structure shown in FIG. 1.

FIG. 3 illustrates a front elevational view of the antenna structure shown in FIG. 1. As shown in FIG. 1, the feeding strip 40 extends across the slot 30. In particular, the feeding strip 40 extends transversely across the second slit 313 and a junction between the first slit 312 and the second sub-slot 32. A junction between the first strip 41 and the second strip 42 is positioned between the first slit 312 and the second slit 313. A length S between the feeding strip 40 and the edge 21 of the ground plane 20 is about 22 mm.

FIGS. 1-3 illustrate that in use, a current signal is fed to the feeding strip 40, and the slot antenna 100 generates a low band frequency to receive/send wireless signals at about 700 MHz. Additionally, the slot antenna 100 resonates with the feeding strip 40 to generate three different high band frequencies to receive/send wireless signals at about 2000 MHz, 2700 MHz, and 3800 MHz, respectively.

Figure 4:
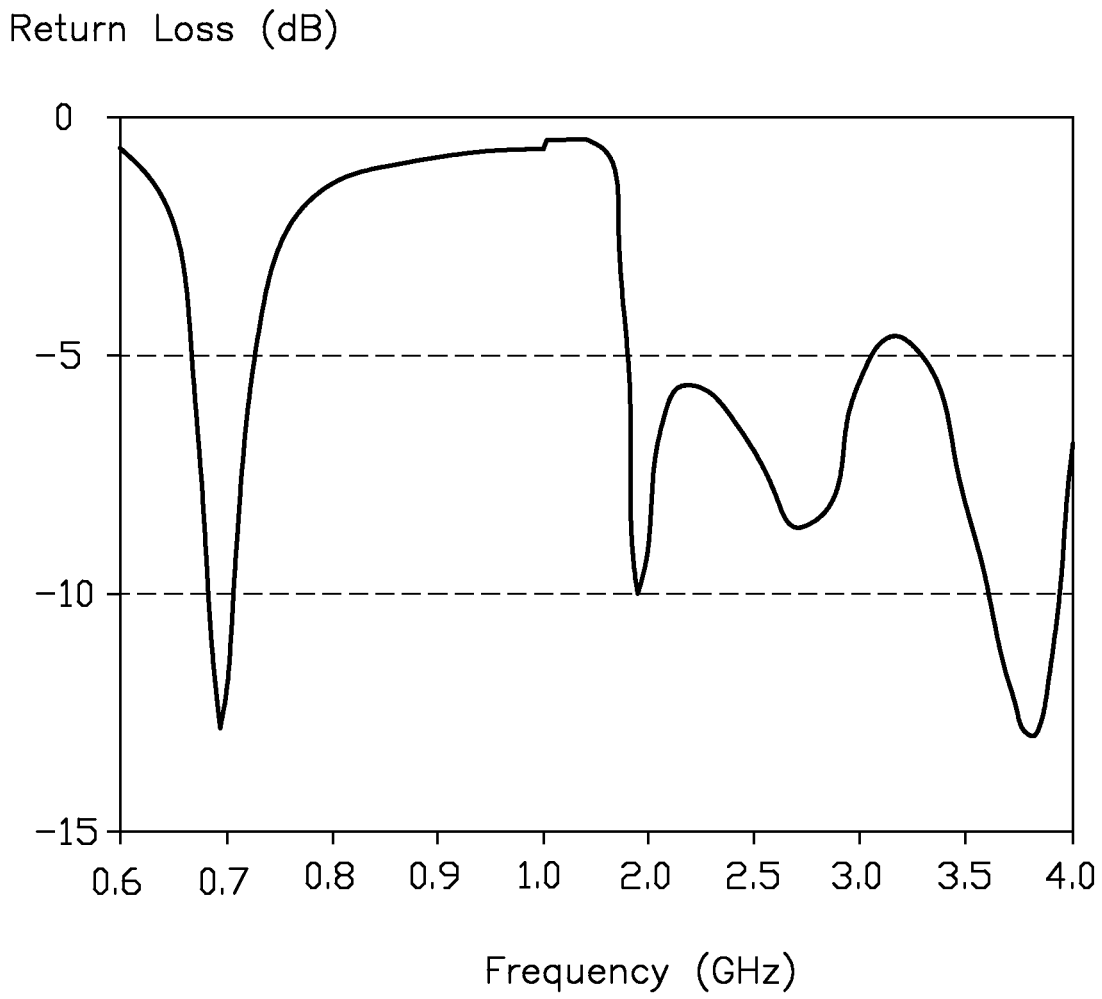
FIG. 4 is a diagram showing return loss (RL) measurements of the antenna structure shown in FIG. 1.

FIG. 4 illustrates a diagram showing return loss (RL) measurements of the antenna structure shown in FIG. 1. As shown in FIG. 4, the RL of the antenna structure 200 is less than −6 dB when the antenna structure 200 receives/sends wireless signals at frequencies from about from 1820 MHz to about 4300 MHz. Accordingly, the antenna structure 200 can be used in common wireless communication systems, such as GSM/DCS/PCS/WCDMA/LTE, with exceptional communication quality.

Figure 5:
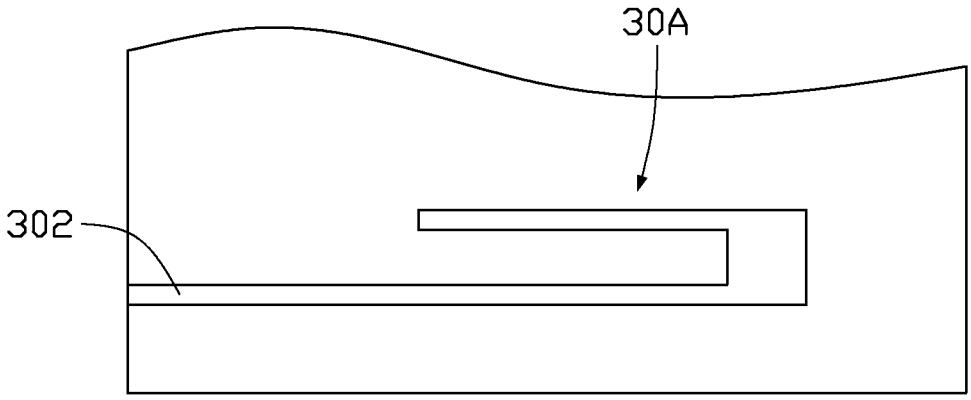
FIGS. 5-8 are elevational views of a slot antenna of the antenna structure shown in FIG. 1, respectively showing four different embodiments of the slot antenna.
Figure 6:
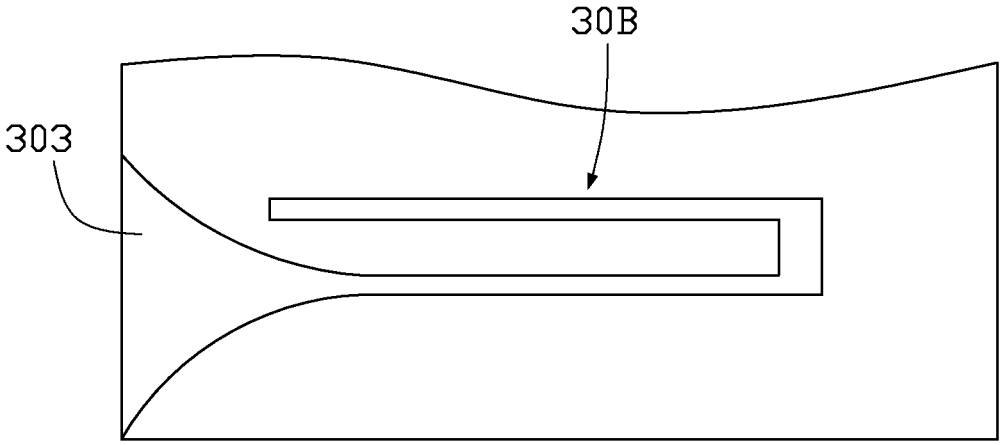
Figure 7:
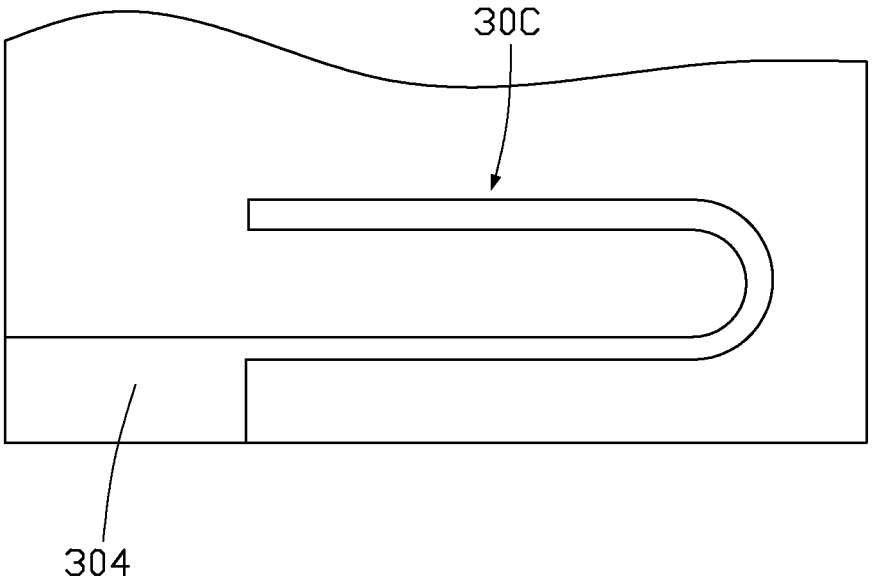
Figure 8:
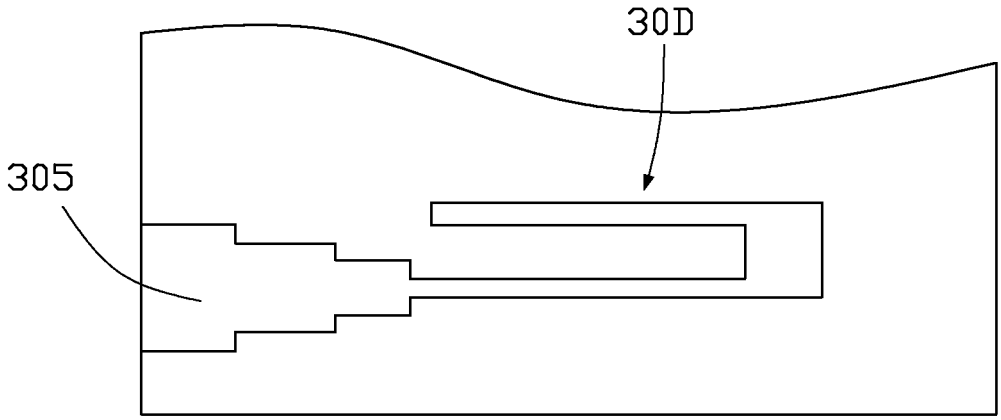

FIGS. 5-8 illustrate elevational views of a slot of the antenna structure shown in FIG. 1, respectively showing four different embodiments of the slot. In FIG. 5, a slot 30A is shown. The slot 30A differs from the slot 30 shown in FIG. 1 in that a second sub-slot 302 replaces the second sub-slot 32 of the slot 30. The second sub-slot 302 is substantially straight and has a width exactly the same as that of the first slit 312. In FIG. 6, a slot 30B is shown. The slot 30B differs from the slot 30 shown in FIG. 1 in that a second sub-slot 303 replaces the second sub-slot 32 of the slot 30. The second sub-slot 303 is substantially horn-shaped with a wider end opening through the edge 21 and a narrower end communicating with the first slit 312. In FIG. 7, a slot 30C is shown. The slot 30C differs from the slot 30 shown in FIG. 1 in that a second sub-slot 304 replaces the second sub-slot 32 of the slot 30, the second sub-slot 304 is rectangular and wider than the first slit 312 of the slot 30. In FIG. 8, a slot 30D is shown. The slot 30D differs from the slot 30 shown in FIG. 1 in that a second sub-slot 305 replaces the second sub-slot 32 of the slot 30. The second sub-slot 305 is a substantially stepped slot with a wider end opening through the edge 21 and a narrower end communicating with the first slit 312.

Figure 9:
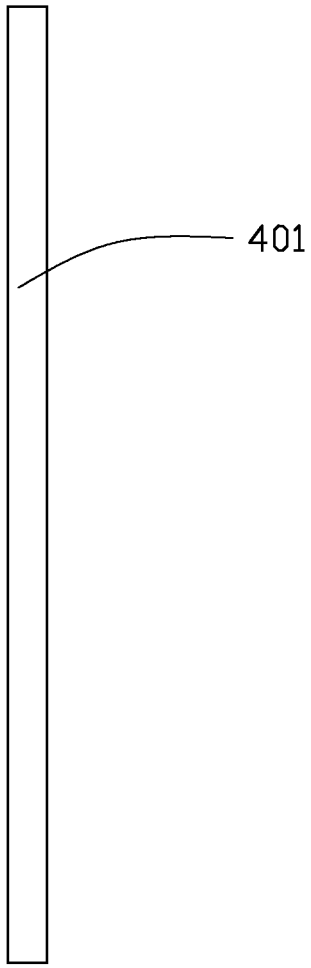
FIGS. 9-11 are elevational views of a feeding strip of the antenna structure shown in FIG. 1, respectively showing three different embodiments of the feeding strip.
Figure 10:
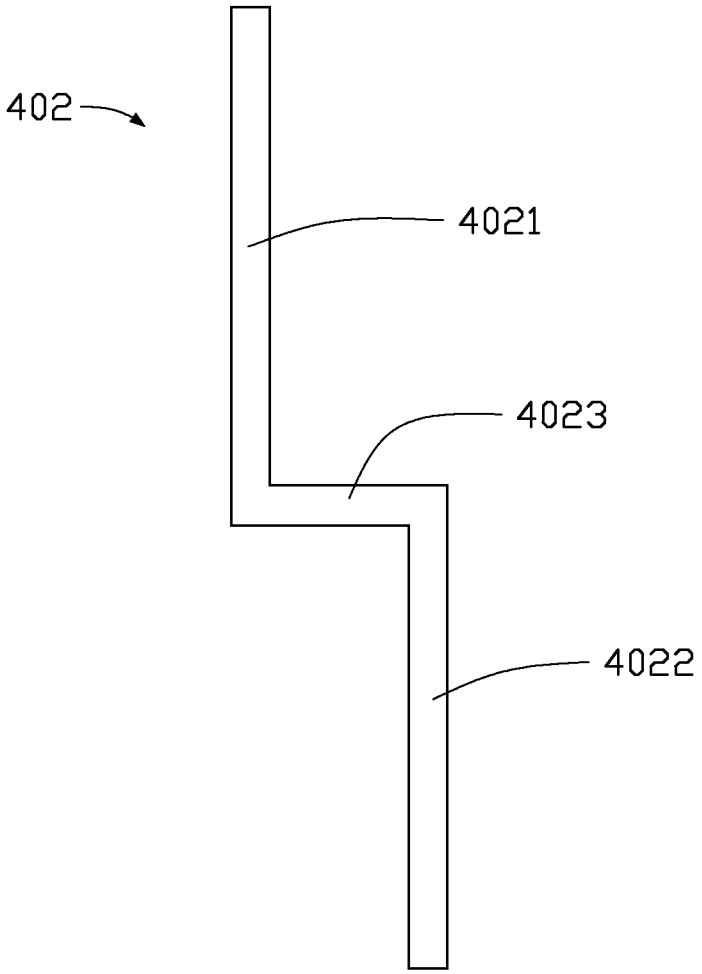
Figure 11:
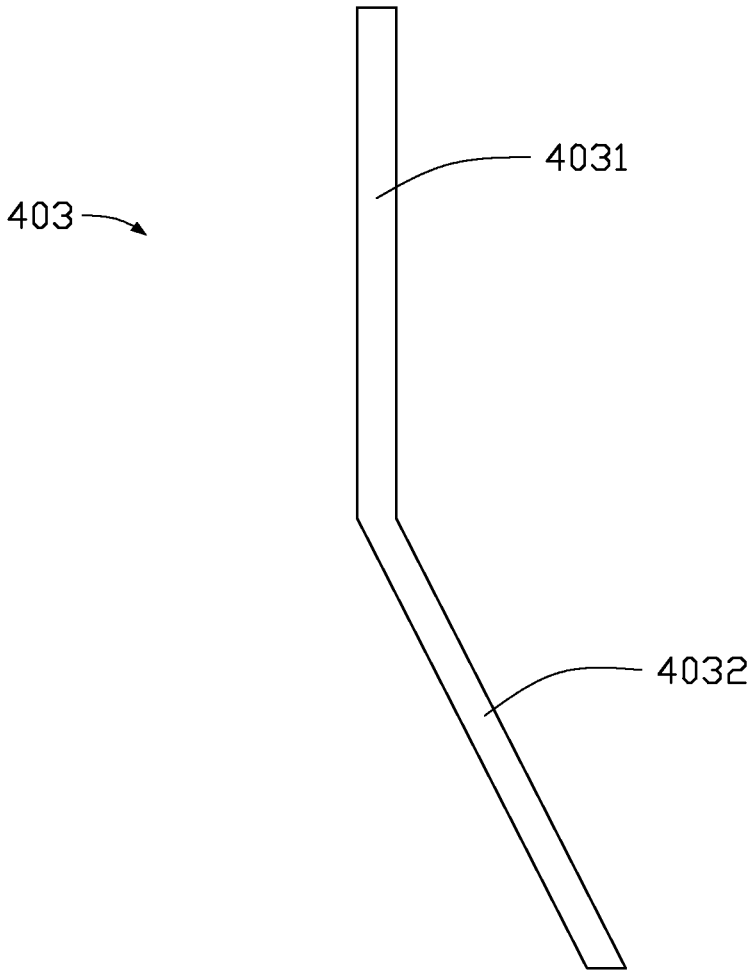

FIGS. 9-11 are elevational views of a feeding strip of the antenna structure shown in FIG. 1, respectively showing three different embodiments of the feeding strip. In FIG. 9, a feeding strip 401 having a straight shape replaces the feeding strip 40 shown in FIG. 1. In FIG. 10, a feeding strip 402 replaces the feeding strip 40 shown in FIG. 1. The feeding strip 402 includes a first strip 4021, a second strip 4022, and a connecting strip substantially perpendicularly connected between the first strip 4021 and the second strip 4022. The first strip 4021 and the second strip 4022 are positioned on two opposite sides of the connecting strip 4023 respectively. In FIG. 11, a feeding strip 403 replaces the feeding strip 40 shown in FIG. 1. The feeding strip 403 includes a first strip 4031 and a second strip 4032 connected to the first strip 4031, the first strip 4031 and second strip 4032 cooperatively form an obtuse angle.

The embodiments shown and described above are only examples. Many details are often found in the art such as the other features of an antenna structure. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a dielectric substrate having:

a first surface, and a second surface opposite the first surface;

a slot antenna comprising:

a ground plane positioned on the first surface of the dielectric substrate, the ground plane being formed from a conductive material; and a slot defined in the ground plane, the slot comprising:

a first sub-slot having a closed-end, a second sub-slot connected to the first sub-slot, the second sub-slot having an opening formed in one end, wherein the opening is through an edge of the ground plane; and a feeding strip positioned on the second surface of the dielectric substrate, the feeding strip configured to resonate with the slot antenna;

wherein the first sub-slot is substantially U-shaped and comprises a first slit, a second slit, and a connecting slit connecting the first slit and the second slit the first slit and second slit are positioned on a same side of the connecting slit.

2. The antenna structure of claim 1, wherein the second sub-slot is connected to the first slit, and is one of a straight slot, a stepped slot, a substantially horn-shaped slot, a substantially trapezoidal slot, and a substantially rectangular slot wider than the first slit.

3. The antenna structure of claim 1, wherein the feeding strip extends transversely across the first slit and the second slit.

4. The antenna structure of claim 3, wherein the feeding strip comprises a first strip and a second strip extending continuously from the first strip and being narrower than the first strip; a junction being formed between the first strip and the second strip, the junction is positioned between the first slit and the second slit.

5. The antenna structure of claim 3, wherein the feeding strip is a straight strip.

6. The antenna structure of claim 3, wherein the feeding strip comprises a first strip, a second strip and a connecting strip substantially perpendicularly connecting the first strip and the second strip, the first strip and the second strip are positioned on two opposite sides of the connecting strip respectively.

7. The antenna structure of claim 3, wherein the feeding strip comprises a first strip and a second strip connected to the first strip, the first strip and second strip cooperatively form an obtuse angle.

8. An antenna structure comprising:

an dielectric substrate having a first surface and a second surface opposite to the first surface;

a slot antenna comprising:

a ground plane position on the first surface of the dielectric substrate; and a slot defined in the ground plane where the conductive material is missing and open at an edge of the ground plane; and a feeding strip positioned on the second surface of the dielectric substrate and extending across the slot, the feeding strip configured to resonate with the slot antenna;

wherein the slot comprises a first sub-slot having a closed-end; the first sub-slot is substantially U-shaped and comprises a first slit, a second slit and a connecting slit connecting the first slit and the second slit, the first slit and second slit are positioned on a same side of the connecting slit.

9. The antenna structure of claim 8, wherein the slot further comprises a second sub-slot connecting to the first sub-slot, the second sub-slot having an open-end that extends to the edge of the ground plane.

10. The antenna structure of claim 9, wherein the second sub-slot is connected to the first slit, and is one of a straight slot, a stepped slot, a substantially horn-shaped slot, a substantially trapezoidal slot, and a substantially rectangular slot wider than the first slit.

11. The antenna structure of claim 9, wherein the feeding strip extends transversely across the first slit and the second slit.

12. The antenna structure of claim 11, wherein the feeding strip comprises a first strip and a second strip extending continuously from the first strip and being narrower than the first strip; a junction being formed between the first strip and the second strip, the junction is positioned between the first slit and the second slit.

13. The antenna structure of claim 11, wherein the feeding strip is a straight strip.

14. The antenna structure of claim 11, wherein the feeding strip comprises a first strip, a second strip and a connecting strip substantially perpendicularly connecting the first strip and the second strip, the first strip and the second strip are positioned on two opposite sides of the connecting strip respectively.

15. The antenna structure of claim 11, wherein the feeding strip comprises a first strip and a second strip connected to the first strip, the first strip and second strip cooperatively form an obtuse angle.

16. A wireless communication device, comprising:

an dielectric substrate having a first surface and a second surface opposite to the first surface;

a slot antenna comprising:

a ground plane position on the first surface of the dielectric substrate;

a slot defined in the ground plane where the conductive material is missing and open at an edge of the ground plane; and a feeding strip positioned on the second surface of the dielectric substrate and extending across the slot, the feeding strip configured to resonate with the slot antenna;

wherein the slot comprises a first sub-slot having a closed-end, the first sub-slot is substantially U-shaped and comprises a first slit, a second slit and a connecting slit connecting the first slit and the second slit, the first slit and second slit are positioned on a same side of the connecting slit.

17. The wireless communication device of claim 16, wherein the slot further comprises a second sub-slot connecting to the first sub-slot, the second sub-slot having an open-end that extends to the edge of the ground plane.

18. The wireless communication device of claim 16, wherein the second sub-slot is connected to the first slit, and is one of a straight slot, a stepped slot, a substantially horn-shaped slot, a substantially trapezoidal slot, and a substantially rectangular slot wider than the first slit.

* * * * *